United States Patent [19]

Bruning

[11] Patent Number: 4,460,352

[45] Date of Patent: Jul. 17, 1984

[54] CENTRIFUGE DRUM FOR CLARIFYING AND/OR SEPARATING LIQUIDS

[75] Inventor: Paul Bruning, Oelde, Fed. Rep. of Germany

[73] Assignee: Westfalia Separator AG, Oelde, Fed. Rep. of Germany

[21] Appl. No.: 459,015

[22] Filed: Jan. 18, 1983

[30] Foreign Application Priority Data

Jan. 22, 1982 [DE] Fed. Rep. of Germany ..... 3201866

[51] Int. Cl.[3] ..... B04B 11/06; B04B 11/08

[52] U.S. Cl. ..... 494/70; 494/29

[58] Field of Search ..... 494/67, 68, 69, 70, 494/71, 72, 73, 74, 23, 27, 28, 29

[56] References Cited

U.S. PATENT DOCUMENTS

| | | | |
|---|---|---|---|
| 1,759,522 | 5/1930 | Schmitz | 494/70 |
| 2,028,955 | 1/1936 | Shenstone | 494/70 |
| 3,187,998 | 6/1965 | Madany | 494/70 |
| 4,026,462 | 5/1977 | Tenthoff | 494/70 |
| 4,142,671 | 3/1979 | Ivin | 494/73 |

*Primary Examiner*—Robert W. Jenkins

*Attorney, Agent, or Firm*—Sprung, Horn, Kramer & Woods

[57] ABSTRACT

A centrifuge drum with a beveled-plate insert consists of individual plates held apart by spacing strips. The plates are mounted on a distributor foot. The bottom of the distributor foot has channels through which the liquid to be centrifuged is conducted into the separation space. There are ribs in the separation space. Between the ribs are lifting channels into which the channels in the distributor foot empty. The lifting channels are formed by the ribs and are positioned behind the spacing strips in the direction in which the drum rotates. The layout of the lifting channels prevents the liquid flowing into the plate insert from mixing with the solid particles that have been centrifuged out and are sliding out of the insert.

8 Claims, 4 Drawing Figures

CENTRIFUGE DRUM FOR CLARIFYING AND/OR SEPARATING LIQUIDS

BACKGROUND OF THE INVENTION

The present invention relates to a centrifuge drum for clarifying and/or separating liquids which has a beveled-plate insert consisting of individual plates held apart by spacing strips and resting on a distributor foot, the bottom of which has channels through which the liquid to be centrifuged is introduced into a separation space in which there are ribs.

Centrifuges of this type are known, from French Pat. No. 1,426,079 for example, which specifies a centrifuge drum for separating mixtures of liquids. The liquid to be separated is fed into that drum through a central feed tube and conveyed through channels below the bottom of the distributor into the separation space. Upon leaving the distributor foot, the liquid flows axially along the outer edge of a package of plates, some of the heavier phase already having been separated. The lighter phase is distributed among the spaces between the plates, in which the remainder of the heavier phase gets separated. The separated heavier phase leaves the plate insert radially, flowing against the liquid entering the plate insert for clarification. This crosswise flow results in further mixing of the previously separated heavier phase with the liquid to be clarified and hence affects the separation process.

The problem can be largely solved by providing the plates with vertical holes positioned along a common arc of a circle in such a way as to form lifting channels, through which the liquid to be centrifuged can be conveyed, once the insert has been assembled. The separated heavier phase can then flow along the lifting channels into the separation space in the drum. Although the vertical holes reduce the clarification surface of the plate insert to some extent, clarification is still considerably more successful than without them.

If, however, the liquid to be centrifuged contains fibrous solids, the lifting channels will clog up after a certain amount of time, and centrifuging must be interrupted so that the drum can be cleaned by hand.

Attempts have been made, to prevent the holes from getting clogged by making them open toward the outer edge of the plate, turning them essentially into slits opening into the separation space, so that the separated solids can exit freely from the lifting channels.

It has, however, been demonstrated that, although the channels can indeed be prevented in this way from clogging up with fibrous solids, the slits also weaken the plate insert undesirably. The channels interrupt the beveled mantle of the plates in fact just where the centrifugal forces are most powerful. The interrupted edges of the plates deform under centrifugal force and partly block the spaces between them. The diminished space also gets clogged with fibrous solids and the deformed plates lead to problems in assembly.

SUMMARY OF THE INVENTION

The objective of the present invention is to provide a centrifuge drum of the type initially described that does not involve these problems.

This objective is attained by lifting channels between the ribs, with the channels of the distributor foot emptying into the lifting channels. It is practical for the lifting channels to be positioned directly behind the spacing strips in the sense in which the drum rotates so that the higher peripheral speed, in relation to the inside diameter of the plates, of the liquid to be centrifuged and flowing into the plate insert, will cause it to flow against these strips, Whereas the separated heavier phase will flow as it travels toward the outside edge of the plate against the strips that are toward the rear in the sense of rotation. This set-up will prevent a reciprocal effect as the result of a crosswise flow.

In a further embodiment of the invention the outside diameter of the distributor foot extends beyond the outer edge of the plate insert and there are vertical holes in the overhanging part that empty into the lifting channels.

It is also practical for the channels below the distributor foot to extend below the overhanging part of the foot, although only to the radially outside edge of the vertical holes, of course. This results in a non-ribbed space in the distributor foot as it continues, in which the liquid being centrifuged is not accelerated any further. This generates a pressure head in the space, in relation to the rest of the separation space, that prevents an undesired flow of the liquid into the separation space. The solids centrifuged out below the distributor foot can, however, still slip through the remaining annular gap at the outside diameter of the foot into the separation space.

In one embodiment of the invention the lifting channels are formed by additional rips in the separation space. The channels below the distributor foot are not wider than the lifting channels and empty into these. The distributor foot of this embodiment has an outside diameter which is equal to that of the plate insert.

In a further embodiment, instead of a non-ribbed space, the distributor foot can also be sealed off where it joins the vertical holes to the separation space to prevent undesired flow.

The drawings illustrate two embodiments of a centrifuge drum for clarifying liquids that contain solids, as examples of the invention and wherein:

DETAILED DESCRIPTION OF THE INVENTION

Figure 1:
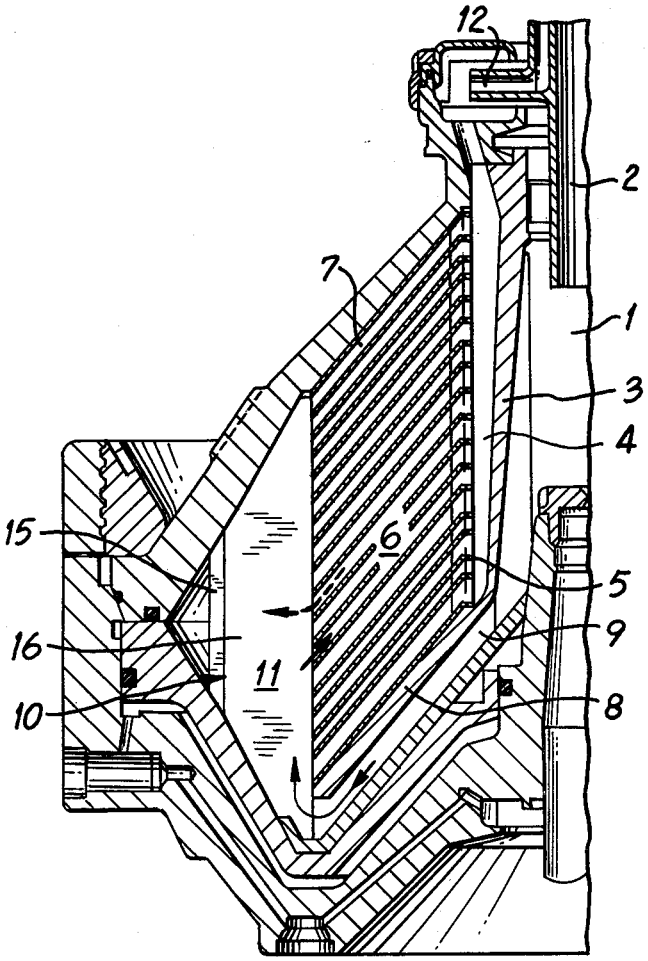
FIG. 1 is a sectional view of the left half of a centrifuge drum that has a distributor foot with an outside diameter equal to that of the plate insert.

Liquid with a concentration of solids is, as shown in FIG. 1, fed into the inlet space 1 of the centrifuge drum through a stationary access tube 2. There are longitudinal ribs 4 on the outside of a distributor 3. Ribs 4 engage matching recesses in the individual plates 5 in such a way that the number of plates, which form a plate insert 6, is uniform and so that spacing strips 7 will be positioned one above another. There are channels 9 in distributor foot 8 that are no wider than and empty into lifting channels 10 in a separation space 11. Lifting channels 10 are formed by ribs 15 and 16.

Figure 2:
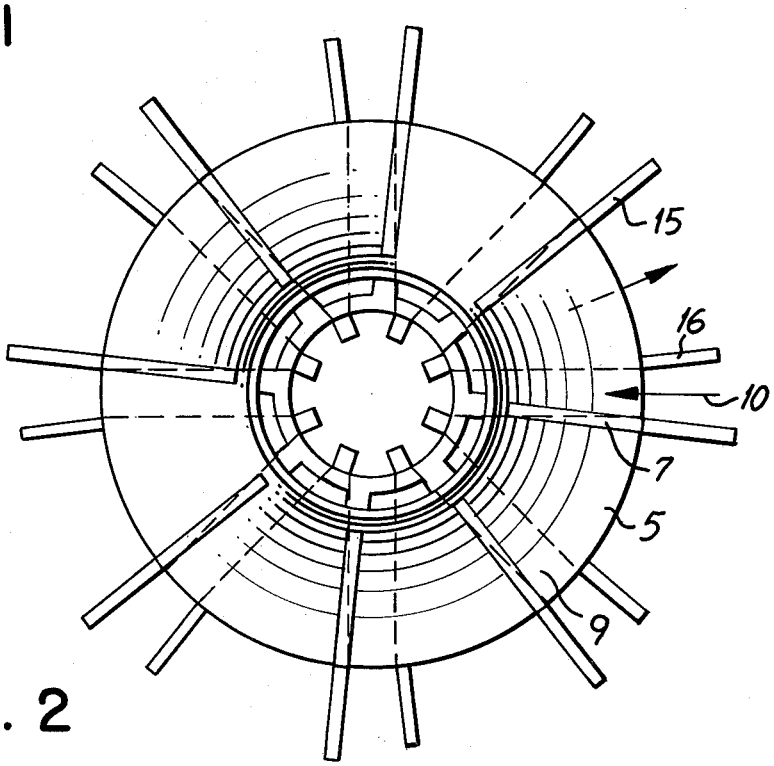
FIG. 2 is a top view of the plate insert in the FIG. 1 with lifting channels between its ribs.

FIG. 2 is a top view of the plate insert 6 with its concentric lifting channels 10, which are positioned behind the spacing strips in the sense in which the drum rotates.

The operation of a drum with lifting channels in accordance with the invention will now be specified.

The liquid conveyed into inlet space 1 from access tube 2 travels through channels 9 in distributor foot 8 into lifting channels 10 and is simultaneously set rotating. This will immediately separate the coarser solid particles out of the liquid.

The liquid, still containing the finer solid particle, rises through lifting channels 10 and enters plate insert 6 behind spacing strips 7 in the sense in which the drum is rotating. In attempting to retain its peripheral speed, the liquid flows on its way to a diameter of lower peripheral speed against the strips 7 that are in front of it in the sense in which the drum is rotating and is diverted, in this embodiment, over a skimming disk 12.

The solids centrifuged off in plate insert 6, on the other hand, slide along against the strips 7 that are toward the rear in the sense of rotation because they are moving on a diameter of higher peripheral speed and will thus separate freely from the entering liquid into separation space 11.

Figure 3:
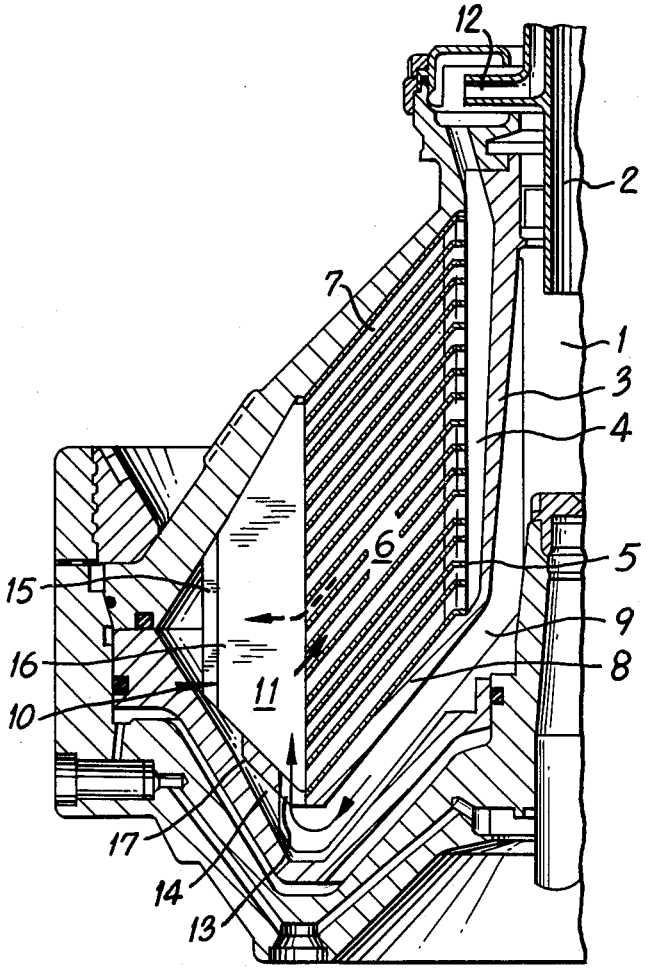
FIG. 3 is a sectional view of the left half of a centrifuge that has a distributor foot with an outside diameter that is longer than that of the plate insert.
Figure 4:
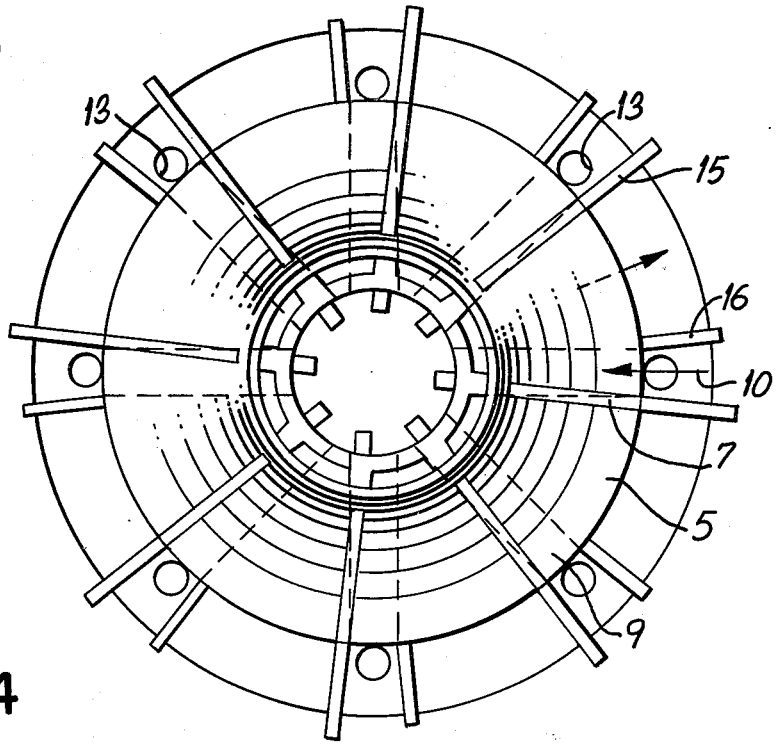
FIG. 4 is a top view of the plate insert in FIG. 3 with lifting channels between its ribs

FIGS. 3 and 4 illustrate another embodiment in which distributor foot 8 extends beyond the outside diameter of plate insert 6 into separation space 11 and has vertical holes 13 that merge into lifting channels 10. A non-ribbed annular space 14 prevents a destructive flow of liquid into separation space 11. The solids centrifuged off below the distributor foot slide through annular gap 17 into separation space 11. Instead of a non-ribbed annular space, however, distributor foot 8' can also be sealed off from separation space 11 by a known method.

The utilization of lifting channels in accordance with the present invention is not limited to the specified centrifuge drum. but may also be employed in any type of centrifuge drum with a beveled-plate insert.

It will be appreciated that the instant specification and claims are set forth by way of illustration and not limitation, and that various modifications and changes may be made without departing from the spirit and scope of the present invention.

What is claimed is:

1. In a centrifuge drum for clarifying and/or separating liquids, having a beveled-plate insert comprising individual plates held apart by spacing strips and resting on a distributor foot, the bottom of which has channels through which the liquid to be centrifuged is introduced into a separation space in which there are ribs, the improvement comprising: means forming lifting channels between the ribs and wherein the channels of the distributor foot empty into the lifting channels.

2. The centrifuge drum according to claim 1, wherein the means forming the lifting channels comprises the ribs in the separation space.

3. The centrifuge drum according to claim 2, wherein the lifting channels are disposed behind the spacing strips in the sense in which the drum rotates.

4. The centrifuge drum according to claim 1, wherein the lifting channels are disposed behind the spacing strips in the sense in which the drum rotates.

5. The centrifuge drum according to claim 1, wherein the outside diameter of the distributor foot is greater than that of the plate insert.

6. The centrifuge drum according to claim 5, further comprising means forming vertical holes in the part of the distributor foot that extends beyond the outside diameter of the plate insert and merging into the lifting channels.

7. The centrifuge drum according to claim 6, wherein the channels in the distributor foot end at the outside edge of the vertical holes.

8. The centrifuge drum according to claim 5, wherein the distributor foot is configured to form an annular gap between the outside diameter of the distributor foot and the lower boundary of the separation space.

* * * * *